US005778663A

United States Patent [19]

Kostka

[11] Patent Number: 5,778,663

[45] Date of Patent: Jul. 14, 1998

[54] METHOD FOR CONTROLLING THE PURIFICATION OF EXHAUST GASES FROM AN INTERNAL COMBUSTION ENGINE

[75] Inventor: Jürgen Kostka, Lehre, Germany

[73] Assignee: Volkswagen AG, Wolfsburg, Germany

[21] Appl. No.: 744,926

[22] Filed: Nov. 6, 1996

[30] Foreign Application Priority Data

Nov. 11, 1995 [DE] Germany ..... 195 42 110.8

[51] Int. Cl.[6] ..... F01N 3/20

[52] U.S. Cl. ..... 60/274; 60/276; 60/285

[58] Field of Search ..... 60/274, 276, 277, 60/285

[56] References Cited

U.S. PATENT DOCUMENTS

| | | | |
|---|---|---|---|
| 5,158,058 | 10/1992 | Yoshida et al. | 60/274 X |
| 5,255,512 | 10/1993 | Hamburg et al. | 60/274 |
| 5,433,071 | 7/1995 | Willey et al. | 60/274 |

FOREIGN PATENT DOCUMENTS

| | | |
|---|---|---|
| 3339429 | 5/1985 | Germany . |
| 3830515 | 3/1990 | Germany . |

OTHER PUBLICATIONS

"The Effect of Gasoline Composition on Exhaust Emissions from Modern BMW Vehicles" by Lange et al.; pp. 81–100. No date.

"$NO_x$ Aromatics Effects in Catalyst–Equipped Gasoline Vehicles" by Le Jeune et al.; pp. 119–134. No date.

*Primary Examiner*—Tony M. Argenbright

*Attorney, Agent, or Firm*—Baker & Botts, L.L.P.

[57] ABSTRACT

In the embodiments disclosed in the specification, an exhaust gas purifier includes an exhaust line which leads from an internal combustion engine and includes a catalytic converter, a first oxygen sensor upstream of the catalytic converter and a second oxygen sensor downstream of the catalytic converter which provides an output signal used as a reference to correct errors in fuel injection time resulting from drift of the first oxygen sensor when fuel with a low content of aromatics is used in place of conventional fuel.

4 Claims, 2 Drawing Sheets

METHOD FOR CONTROLLING THE PURIFICATION OF EXHAUST GASES FROM AN INTERNAL COMBUSTION ENGINE

BACKGROUND OF THE INVENTION

This invention relates to methods for controlling the purification of exhaust gases from an internal combustion engine.

The present invention provides an improvement in the universally known and presently customary method for controlling an exhaust gas purifier having a three-way catalytic converter and an oxygen sensor. In that arrangement, the exhaust gas purifier includes at least one exhaust gas catalytic converter in the exhaust line of an internal combustion engine and an oxygen sensor positioned upstream of the catalytic converter which is designed as a lambda sensor and provides output signals to a control unit. During the operation of the internal combustion engine, the control unit controls the injection times of a fuel injection device in such a way that the exhaust gas catalytic converter receives a stoichiometric fuel/air ratio, i.e. one part of fuel is matched by about 14 parts of air, and the control unit forms a time average from the control fluctuations of the output signal and stores this average.

As in conventional systems, the lambda sensor is sensitive to the oxygen ions supplied with the exhaust gas. The so-called excess air factor lambda is set at the value 1.0 for the stoichiometric ratio. If the mixture supplied to the exhaust gas catalytic converter deviates from the value 1.0, this is detected by the lambda sensor from the residual oxygen content of the exhaust gas and this fact is communicated to the control unit in the form of a modified electrical output signal. If lambda values below 1.0 are indicated, a rich mixture is present and the control unit makes a correction in the direction of an optimum mixture by providing shorter injection times. When the value for lambda is above 1.0, a lean mixture is present and the control unit establishes the desired fuel/air ratio by increasing the injection times.

The conventional exhaust gas purifier control system described above functions with sufficient accuracy over wide ranges and, within limits, it is also possible to use it with different fuel grades.

With stricter environmental requirements, however, it may be that fuel grades with a reduced proportion of aromatics, for example benzene, will come onto the market in the future. Such changes are to be welcomed, since, for example, benzene is regarded as carcinogenic. Fuel grades used at the present time have an aromatic content of about 45%, whereas future requirements point in the direction of about 30%.

However, the use of fuels with a low content of aromatics gives rise to the following problem in the control of conventional exhaust gas purifiers. The reduction in the content of aromatics results in a rise in the concentration of hydrogen in the untreated exhaust gas. Because of the small size of the hydrogen molecules, they reach the hydrogen-sensitive surface of the lambda sensor which is exposed to the exhaust gas to an increased extent. As a result of the deposition of hydrogen molecules, the lambda sensor becomes less and less sensitive to the residual oxygen in the exhaust gas. As a result, there is a change in the output voltage curve of the lambda sensor such that lambda values below 1.0 are indicated, i.e., a rich mixture, without any corresponding reduction in the oxygen content of the exhaust gas. The control unit attempts to correct this apparent rich mixture by reducing the fuel injection times.

However, this correction is not in fact necessary since the lambda sensor is merely emitting a faulty signal while, in fact, a stoichiometric fuel/air ratio may be present.

SUMMARY OF THE INVENTION

Accordingly, it is an object of the present invention to provide a method for controlling the purification of exhaust gases from an internal combustion engine which overcomes the disadvantages of the prior art.

Another object of the invention is to provide a method for controlling exhaust gas purification for an internal combustion engine which, despite the use of fuels that produce an increased hydrogen content in the untreated exhaust gas, particularly fuels with a reduced content of aromatics compared with conventional fuels, establishes a stoichiometric fuel/air ratio.

These and other objects of the invention are attained by detecting the oxygen content of the exhaust gas which has passed through a catalytic converter, storing an average value of the detected content in a memory, comparing the average value with another value which may be an average of the oxygen content detected upstream of the catalytic converter or a predetermined limiting value, and providing a correction signal to a control unit for controlling fuel injection to the engine based on the comparison of the values.

Thus, to compensate for a faulty sensor signal of an oxygen sensor arranged upstream of the catalytic converter, a second oxygen sensor downstream of the catalytic converter is used as a reference sensor since it can operate without being affected by any excess of hydrogen molecules in the exhaust gas because the hydrogen is converted to $H_2O$ in the exhaust gas catalytic converter.

According to a first aspect of this invention, the average value from the sensor signal of the second oxygen sensor is compared in a memory unit with the average value from the oxygen sensor situated upstream of the catalytic converter. If the lambda control system is operating properly, this comparison will give an identical value for the average value upstream and downstream of the catalytic converter. If, during the operation of the internal combustion engine, a fuel is used which brings about an increased hydrogen content in the untreated exhaust gas, in particular a fuel with a low content of aromatics, the characteristic curve of the first oxygen sensor will be shifted because of its hydrogen sensitivity and a rich mixture, which is not in fact present, will be indicated to the control unit, with the result that the control unit will cause the fuel mixture to be weakened by reducing the injection times.

Such unnecessary weakening of the fuel mixture is reliably detected by a lower output signal from the second oxygen sensor of the fuel mixture. A continuously repeated comparison between the signal from the second oxygen sensor and that from the customary upstream oxygen sensor in a comparator produces a correction signal which is sent to the control unit if a predetermined threshold value is exceeded so that the injection times specified by the control unit are increased to compensate for the erroneously weakened fuel mixture until a stoichiometric fuel/air ratio is once more produced.

According to a second aspect of the invention, comparison of the output signal from the second oxygen sensor situated upstream of the catalytic converter is dispensed with and, instead, the signal value from the oxygen sensor downstream of the catalytic converter is compared in the comparator with a stored fixed value. This fixed value is chosen so that it is at a sufficient spacing from the detector output signal established when using presently customary fuel grades, permitting the output signal to fluctuate within a certain range. On the other hand, the fixed value is chosen with sufficient sensitivity to assure that a significant deviation of the oxygen sensor output signal resulting from the use of a fuel with a low content of aromatics causes this fixed limiting value being reached, if not exceeded. As in the first method described above, a correction signal is then triggered.

By using the method of the present invention, it is advantageously possible to solve the above-described problem in an extremely simple manner. The use of a second conventional oxygen sensor makes it possible to compensate for incorrect control signals produced by the first sensor while retaining the known control system for the exhaust gas purifier.

These advantages will be significant particularly when fuel grades with different contents of aromatics become available on the market. If fuels with a low content of aromatics come to be used throughout the market, the second oxygen sensor can, for example, be used to assess the operation of the exhaust gas catalytic converter, as described, for example, in German offenlegungsschrift No. 38 30 515.

The methods of the present invention can be used irrespective of the sequence or mixing ratio in which different fuels are used. The comparator recognizes the direction in which, and the amount by which, the currently determined second oxygen sensor signal or its average differs from the average of the oxygen sensor located upstream of the catalytic converter. Only in the case of a deviation in the average which exceeds a predeterminable threshold value are the injection times lengthened for the purpose of correction until the averages agree within a permitted tolerance band and stoichiometric fuel/air ratio is thus present.

The effects of different fuel grades on the exhaust emissions of internal combustion engines are described in SAE Paper 941 867 and the relationship between the content of aromatics and the proportions of nitrogen oxides, in particular, are described in SAE Paper 941 869.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
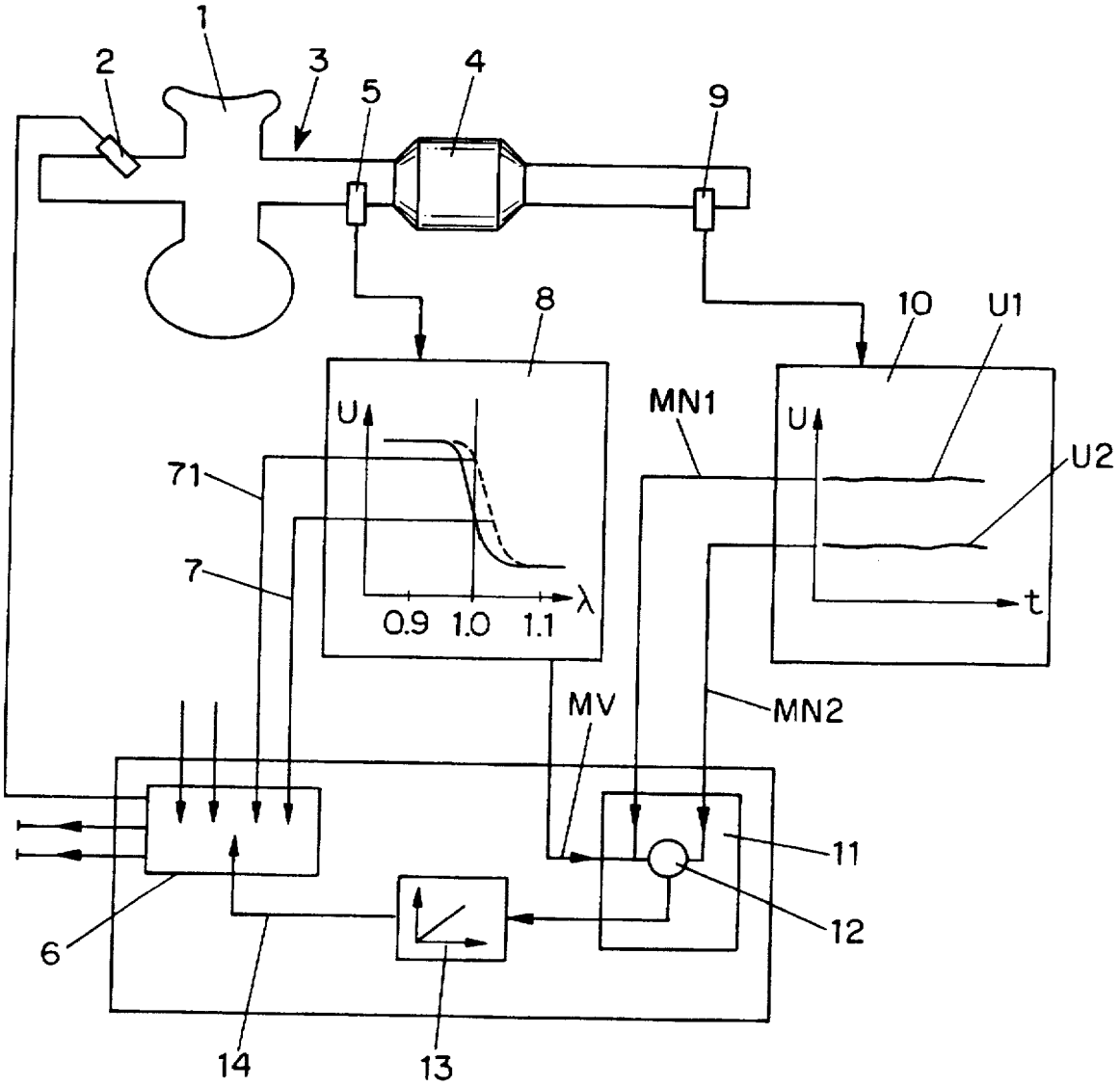
FIG. 1 is a schematic diagram illustrating the arrangement of a representative exhaust gas purification system for carrying out the method of the invention.

In the typical exhaust gas purifier of the invention represented in FIG. 1, an internal combustion engine 1 is supplied on the intake side with an air intake having fuel injection valves 2 providing metering devices for injecting fuel into the intake air to produce a fuel/air mixture.

An exhaust line 3 receives exhaust from the engine and leads to an exhaust gas catalytic converter 4. The exhaust gas purifier furthermore includes a control unit 6 which controls, inter alia, the injection times of the fuel injection valves 2 as a function of a number of parameters.

In the illustrated arrangement, the control circuit is configured so that a stoichiometric fuel/air ratio is established between the internal combustion engine 1 and the exhaust gas catalytic converter 4. A diagram 8 graphically shows one of several possible characteristics of the output signal U with respect to the excess air factor lambda of the oxygen sensor 5. In the presence of a stoichiometric fuel/air ratio, where lambda is equal to 1.0, the oxygen sensor 5 supplies a known output signal 7, which fluctuates about an average value MV in the course of control and which is supplied to the control unit 5. Deviations from the ideal lambda value of 1.0 are indicated to the control unit 6 by an increased or reduced output signal U, and the control unit 6 correspondingly shortens or lengthens the injection times in order to reestablish a lambda value of 1.0. The average value MV is stored in the control unit 6.

A second oxygen sensor 9 in the form of a lambda sensor is inserted into the exhaust line 3 within, or downstream of, the catalytic converter 4. A graphical representation of the time characteristic of the sensor output voltage U with respect to time t for this second oxygen sensor 9 is illustrated in a further diagram 10. The characteristic of this sensor voltage U is shaped to give an average value MN1 which is then stored in a memory unit 11.

While using the presently customary fuel grades which have a comparatively high content of aromatics, an average value MN1 corresponding to a sensor voltage $U_1$ at the second oxygen sensor 9 is established. The average values MV and MN1 are compared with one another in a comparator 12.

If the internal combustion engine 1 is operated with a different fuel having lower content of aromatics, the hydrogen content in the untreated exhaust gas from the internal combustion engine 1 increases. The excess hydrogen molecules collect on the surface of the oxygen sensor 5 which is exposed to the exhaust gas and thus lower the sensitivity of the sensor to oxygen. This results in a drift of the voltage curve, illustrated in broken lines in diagram 8, such that the control unit 6 receives a sensor output signal 71 which indicates a rich mixture, i.e., one in which the excess air factor is below the ideal value.

The control unit 6 responds to this condition in the usual manner by reducing the injection times for the injection valves 2, i.e. the fuel/air mixture is increasingly weakened. The second oxygen sensor 9 is unaffected by the increased hydrogen content in the exhaust gas since the hydrogen is converted in the exhaust gas catalytic converter 4. However, the second oxygen sensor 9 recognizes the weakening of the mixture immediately and therefore supplies a lower sensor voltage signal $U_2$ with a correspondingly lower average value MN2. This average is likewise stored in the memory unit 11 and compared in the comparator 12 with the average value MV. If this comparison reveals a voltage difference which exceeds a predetermined threshold value, a correction signal 14 is read out of a characteristic diagram 13 and supplied to the control unit 6. This is used to modify the normal signal for the injection times determined by the control unit 6 in such a way that the injection times are increased for renewed enrichment of the mixture until the oxygen sensor 5 supplies a correct output signal.

Figure 2:
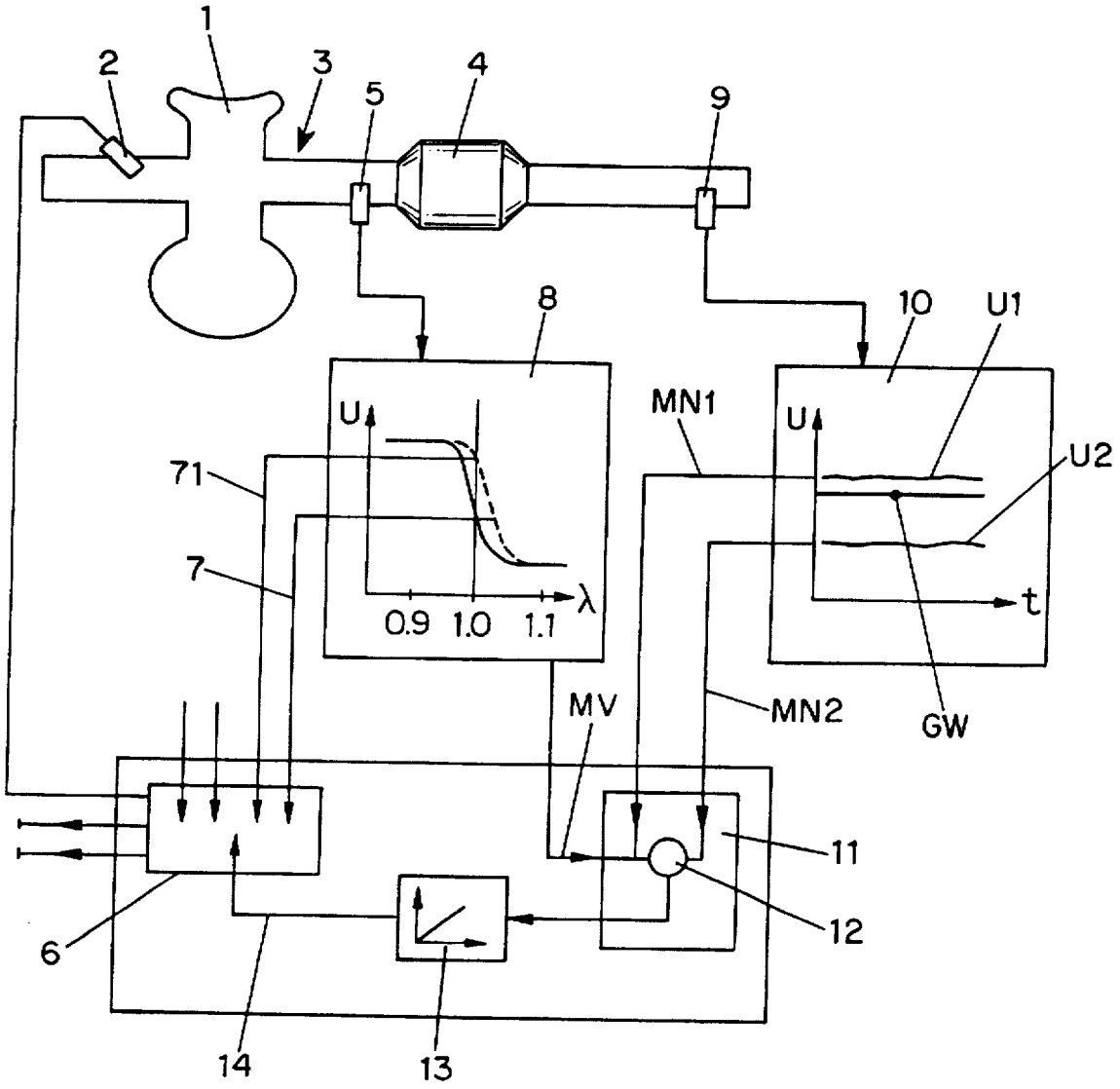
FIG. 2 is a schematic diagram illustrating a modified form of the invention.

A second method is explained with reference to FIG. 2 wherein the components that correspond to those in FIG. 1 are provided with identical reference symbols. This second, simplified method differs from the first method in that the average value MV is not fed to the control unit 6 for the purpose described above but, on the contrary, the respective average value MN1 or MN2 is compared in the comparator 12 with a fixed lower limit value GW stored in the memory 11. This limiting value GW is represented in the diagram 10 by a horizontal line. When the customary fuel grades are used, the sensor output voltage U1 lies above the lower limit value, this being detected in the comparator, and it therefore does not trigger a correction signal 14. If it is ascertained by the comparison in the comparator 12 that a lower value MN2 of the sensor output voltage U2 reaches or undershoots the limiting value GW when a fuel with a low content of aromatics is used, a correction signal 14 is triggered in the manner already described above.

In order to prevent inadvertent application of the above-described procedures during certain operating phases of an internal combustion engine, the can addition may make an additional inquiry as to whether there is a so-called overrun cutoff, i.e., where the injection quantity is equal to zero, or whether a load-change signal, indicating an acceleration, exceeds a predetermined value. If one of these two conditions is present, the control unit blocks the use of the method described above.

If desired, the separately illustrated components including the memory 11, the comparator 12, the characteristic map 13 and the average former, can be an integral part of the control unit 6.

Although the invention has been described with reference to specific embodiments, many modifications and variations therein will readily occur to those skilled in the art. Accordingly, all such variations and modifications are included within the intended scope of the invention.

I claim:

1. A method for controlling an exhaust gas purifier for an internal combustion engine which includes an exhaust line with at least one exhaust gas catalytic converter and at least a first oxygen sensor upstream of the catalytic converter producing output signals which are supplied to a control unit which controls injection times of a fuel metering device so that the exhaust gas catalytic converter is supplied with a stoichiometric fuel/air ratio comprising:

storing in a memory a time average value of the output signals from the first oxygen sensor when a first fuel is used in the engine;

detecting the oxygen content of the exhaust gases by a second oxygen sensor spaced downstream from the first oxygen sensor in the direction of flow of the exhaust gases and at least partly downstream of the exhaust gas catalytic converter;

storing in a memory a time average value of the output signal from the second oxygen sensor when the first fuel is used in the engine;

comparing in a comparator the time average values from the first and second oxygen sensors;

operating the internal combustion engine with a second fuel which differs from the first fuel in that the hydrogen content in the exhaust gas is higher than that in the exhaust gas when the first fuel is used;

storing in a memory an average value of the output signal from the second oxygen sensor when the second fuel is used in the engine;

comparing in the comparator the two average values from the first and second oxygen sensors when the second fuel is used in the engine; and providing a correction signal to the control unit when the comparison reveals that a predetermined threshold value has been exceeded to produce fuel injection times which are increased until a stoichiometric fuel/air ratio is obtained.

2. A method for controlling an exhaust gas purifier for an internal combustion engine which includes an exhaust line with at least one exhaust gas catalytic converter and at least a first oxygen sensor upstream of the catalytic converter producing output signals which are supplied to a control unit which controls injection times of a fuel metering device so that the exhaust gas catalytic converter is supplied with a stoichiometric fuel/air ratio comprising:

detecting the oxygen content of the exhaust gases by a second oxygen sensor spaced downstream from the first oxygen sensor in the direction of flow of the exhaust gases and at least partly downstream from the exhaust gas catalytic converter;

storing in a memory a time average value of the output signals from the second oxygen sensor when a first fuel is used in the engine;

comparing the time average value of the output signal from the second oxygen sensor in a comparator with a stored limiting value;

operating the internal combustion engine with a second fuel which differs from the first fuel in that the hydrogen content in the exhaust gas is higher than that of the exhaust gas when the first fuel is used;

storing the average value of the output signal from the second oxygen sensor when the second fuel is used and comparing that average value in the comparator with the limiting value;

providing a correction signal to the control unit when the average value of the second sensor output signal is at or below limiting value to produce fuel injection times which are increased until a stoichiometric fuel/air ratio is obtained.

3. A method according to claim 1 including:

determining whether an operating phase of the internal combustion engine with overrun cutoff or an operating phase of the internal combustion engine with a load-change signal value which exceeds a predeterminable value is present; and preventing the steps set forth in claim 1 if either of these conditions occur.

4. A method according to claim 2 including:

determining whether an operating phase of the internal combustion engine with overrun cutoff or an operating phase of the internal combustion engine with a load-change signal value which exceeds a predeterminable value is present; and preventing the steps set forth in claim 2 if either of these conditions occur.

* * * * *